US008231511B2

(12) United States Patent
Dalcourt

(10) Patent No.: US 8,231,511 B2
(45) Date of Patent: Jul. 31, 2012

(54) EXERCISER

(75) Inventor: Michol Nasha Dalcourt, Edmonton (CA)

(73) Assignee: ViPR LLC, Solana Beach, CA (US)

( * ) Notice: Subject to any disclaimer, the term of this patent is extended or adjusted under 35 U.S.C. 154(b) by 304 days.

(21) Appl. No.: 12/439,452

(22) PCT Filed: Aug. 24, 2007

(86) PCT No.: PCT/CA2007/001503

§ 371 (c)(1), (2), (4) Date: May 14, 2009

(87) PCT Pub. No.: WO2008/025138

PCT Pub. Date: Mar. 6, 2008

(65) Prior Publication Data

US 2010/0009820 A1 Jan. 14, 2010

(30) Foreign Application Priority Data

Sep. 1, 2006 (CA) ..... 2558330

(51) Int. Cl.
*A63B 21/072* (2006.01)

(52) U.S. Cl. ..... 482/106; 482/93

(58) Field of Classification Search ..... 482/104–108, 482/148, 93, 38–41, 109
See application file for complete search history.

(56) References Cited

U.S. PATENT DOCUMENTS

| | | | | |
|---|---|---|---|---|
| 3,256,015 | A * | 6/1966 | Perrin | 482/129 |
| 4,538,806 | A * | 9/1985 | Wilkerson | 482/108 |
| 4,995,604 | A | 2/1991 | Lynch et al. | |
| 5,692,996 | A * | 12/1997 | Widerman | 482/93 |
| 5,716,305 | A | 2/1998 | Selsam | |
| 2004/0082445 | A1 | 4/2004 | Zabel | |
| 2005/0187075 | A1 | 8/2005 | Bellamy | |
| 2006/0116256 | A1 | 6/2006 | Carney | |
| 2007/0042873 | A1 * | 2/2007 | Lutkov | 482/55 |
| 2007/0167298 | A1 * | 7/2007 | Bystrom | 482/93 |

FOREIGN PATENT DOCUMENTS

| | | |
|---|---|---|
| CA | 2587024 | 11/2005 |
| WO | 9409856 | 5/1994 |
| WO | WO 2005/075026 A1 | 8/2005 |

OTHER PUBLICATIONS

International Search Report and Written Opinion for PCT/CA2007/001503, mailed Nov. 16, 2007, 7 pgs.

PCT International Preliminary Report on Patentability for PCT/CA2007/001503, mailed Nov. 18, 2008, 5 pgs.

European Patent Office; Supplementary European Search Report; European Application No. 07800528.7; May 23, 2011.

* cited by examiner

*Primary Examiner* — Fenn Mathew

(74) *Attorney, Agent, or Firm* — David E. Heisey; Sheppard Mullin Richter & Hampton

(57) ABSTRACT

An exerciser apparatus is disclosed. The apparatus comprises a member having a substantially tubular exterior surface, said surface having a central longitudinal axis. The member has two or more receivers, said two or more receivers including a pair of receivers, axially-spaced from one another. A handle is provided for each receiver. The apparatus can be constructed from a tube, with each receiver being formed by a pair of radially-directed apertures formed through the tube and the handle provided for said each receiver being defined by a strip of the tube separating the pair of apertures.

20 Claims, 7 Drawing Sheets

EXERCISER

The present invention relates to equipment for use in performing physical training exercises.

It is known to exercise by lifting barbells or dumbbells, of the type consisting of annular metal plates fitted on a metal bar and secured in place by collars having set screws for engaging the bar. It is not uncommon for the collars to become loose, in which case, the plates can slip from the bar unless the bar is maintained in a horizontal position. As this could result in severe physical injury, weights of this type are typically only used in exercises wherein the bar can be maintained in a horizontal position, which is relatively limiting. The hard surfaces of dumbbells and barbells also pose problems for fitness centres, since persons using same are prone to allowing same to come to rest on the floor in a less than gentle manner. This is typically resolved through the use of cushioned floor surfaces in areas of gymnasiums and fitness centres reserved for dumbbell and barbell exercising. Notwithstanding the aforementioned limited usefulness of barbells and dumbbells of this type, and the practical need for specialized floor coverings, barbells and dumbbells are ubiquitous in the exercise industry, as they are highly durable and relatively inexpensive to manufacture.

Accordingly, there exists a need for exercise equipment which can be safely used in a wide variety of exercises, which is durable and which is relatively inexpensive to manufacture.

SUMMARY OF THE INVENTION

Apparatus for use by a person performing physical training exercises forms one aspect of the invention. This apparatus comprises a member having a substantially tubular exterior surface. The exterior surface has a central longitudinal axis and defines two or more receivers. The two or more receivers includes a pair of receivers, axially-spaced from one another. For each receiver, a handle for the apparatus is provided, said handle being positioned in said each receiver. Each handle is defined by a length of material connected to the member. Each receiver is defined by an aperture formed through the exterior surface. The member can be elastomeric.

Apparatus for use by a person performing physical training exercises forms another aspect of the invention. This apparatus comprises a member having a substantially tubular exterior surface, said surface having a central longitudinal axis and defining two or more receivers. The two or more receivers includes a pair of receivers, axially-spaced from one another. For each receiver, a handle for the apparatus is provided, said handle being positioned in said each receiver. The member is formed from a tube. Each handle and the receiver for which it is provided are formed by removing portions of the tube longitudinally-flanking said each handle. The member can be elastomeric.

Apparatus for use by a person performing physical training exercises is disclosed. This apparatus comprises a tubular member having a substantially tubular exterior surface, said surface having a central longitudinal axis and defining two or more receivers. The two or more receivers includes a pair of receivers, axially-spaced from one another about the distance between the shoulders of said person. For each receiver, a handle for the apparatus is provided, said handle being positioned in said each receiver. Each handle is defined by a length of material connected to the member. Each receiver is defined by an aperture formed through the tubular member. The tubular member can be rubber.

The apparatus of the present invention can be safely used in a wide variety of exercises, is durable, relatively inexpensive to manufacture and is unlikely to chip or dent a floor if dropped thereupon when made of rubber or other elastomeric materials. Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

DETAILED DESCRIPTION OF THE DRAWINGS

Figure 1:
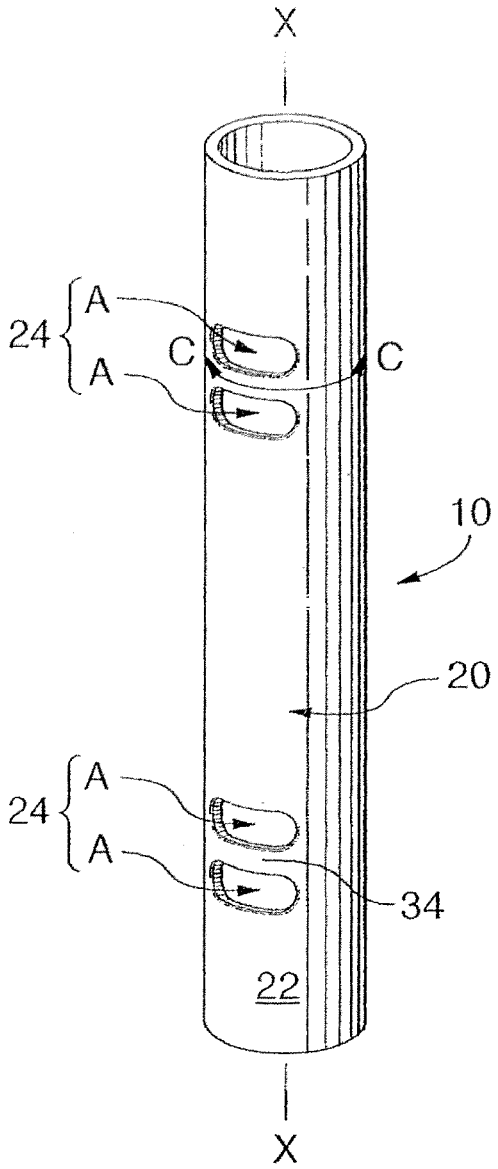
FIG. 1 is a front perspective view of an exerciser apparatus constructed according to an exemplary embodiment of the invention.
Figure 2:
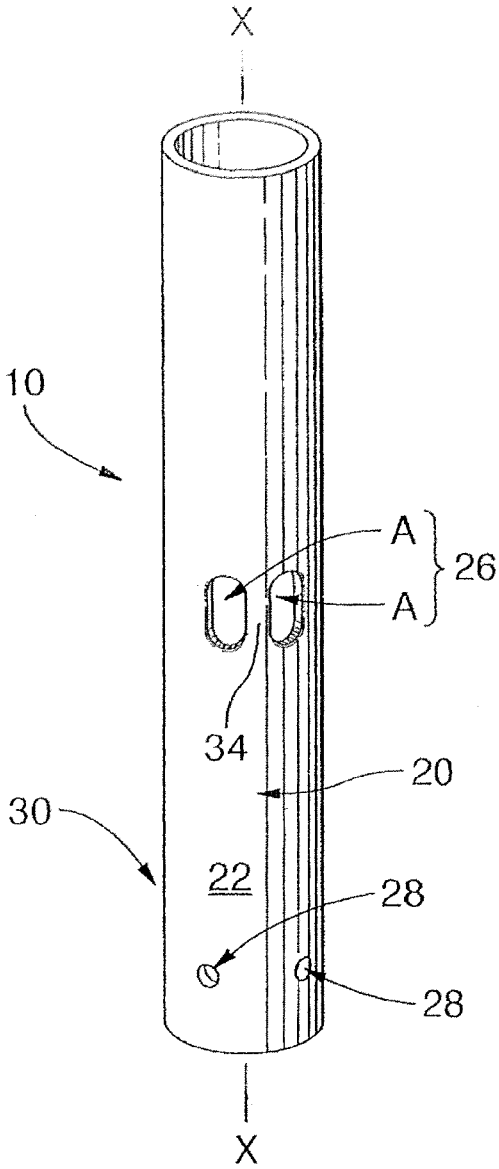
FIG. 2 is a rear perspective view of the structure of FIG. 1.

An exerciser apparatus according to an exemplary embodiment of the present invention is shown in FIG. 1 and FIG. 2, in front and rear perspective view, respectively, and designated with general reference numeral 10.

This apparatus 10 comprises a substantially tubular and cylindrical member 20 formed out of an elastomer, namely, neoprene rubber. The tubular member 20 illustrated is 4 feet in length, and has an outer diameter of 7.875 inches and an inner diameter of 6.5 inches. The weight of the member is about 35 lbs.

Member 20 has a substantially tubular, specifically, cylindrical, exterior surface 22, said surface 22 having a central longitudinal axis X-X.

The member 20 has two or more receivers 24,24,26, each receiver in this embodiment being defined by a pair of radially-directed apertures A in the surface 22. The two or more receivers includes: a pair of receivers 24,24, axially-spaced from one another; and a central receiver 26, longitudinally-intermediate the pair of receivers 24,24 and formed in the surface 22 opposite the pair 24,24. The surface 22 also has defined therein a pair of radially-directed end holes 28, adjacent an end 30 of the member 20.

The apparatus 10 further has a handle 34 for and positioned in each receiver 24,24,26, the handle in this embodiment being defined by a length of rubber material separating the apertures A,A of said each receiver 24, 24,26 from one another and connected to the member 20 to form a smooth extension of the exterior surface 22. Each handle 34 of the pair of handle-receivers 24,24 is substantially aligned with an arc C-C of a circle which is centered about and normal to the longitudinal axis X-X. The handle 34 of the central receiver 26 extends longitudinally.

The member 20 and handles 34 illustrated are produced from black Neoprene rubber [65+/−5 A hardness, 2000 psi tensile, 350% elongation] in sheet form. The sheet material is rolled onto a mandrel until a tube of desired thickness and mass is produced, and then cured in an autoclave. Each handle and the aperture for which it is provided are formed by removing portions of the cured tube which flank said each handle. Removal of such material can be by any conventional method, such as saw, water-jet, stamping, laser, etc.

Figure 8:
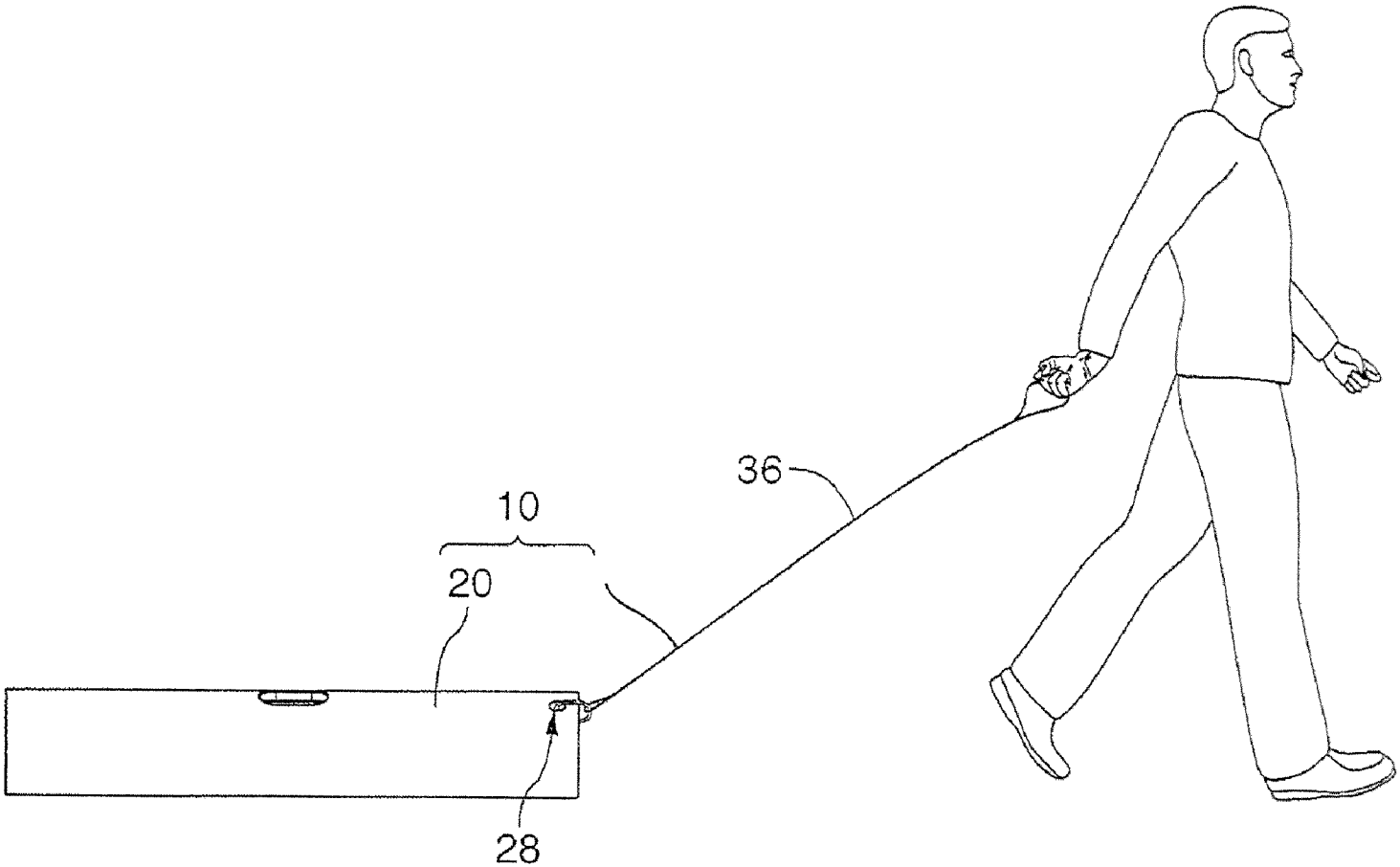
FIG. 8 is a view of the apparatus of FIG. 1 in a fourth exemplary use.

The apparatus further comprises a strap 36 securable to said member via one or both of said holes 28, as shown in FIG. 8.

Figure 3:
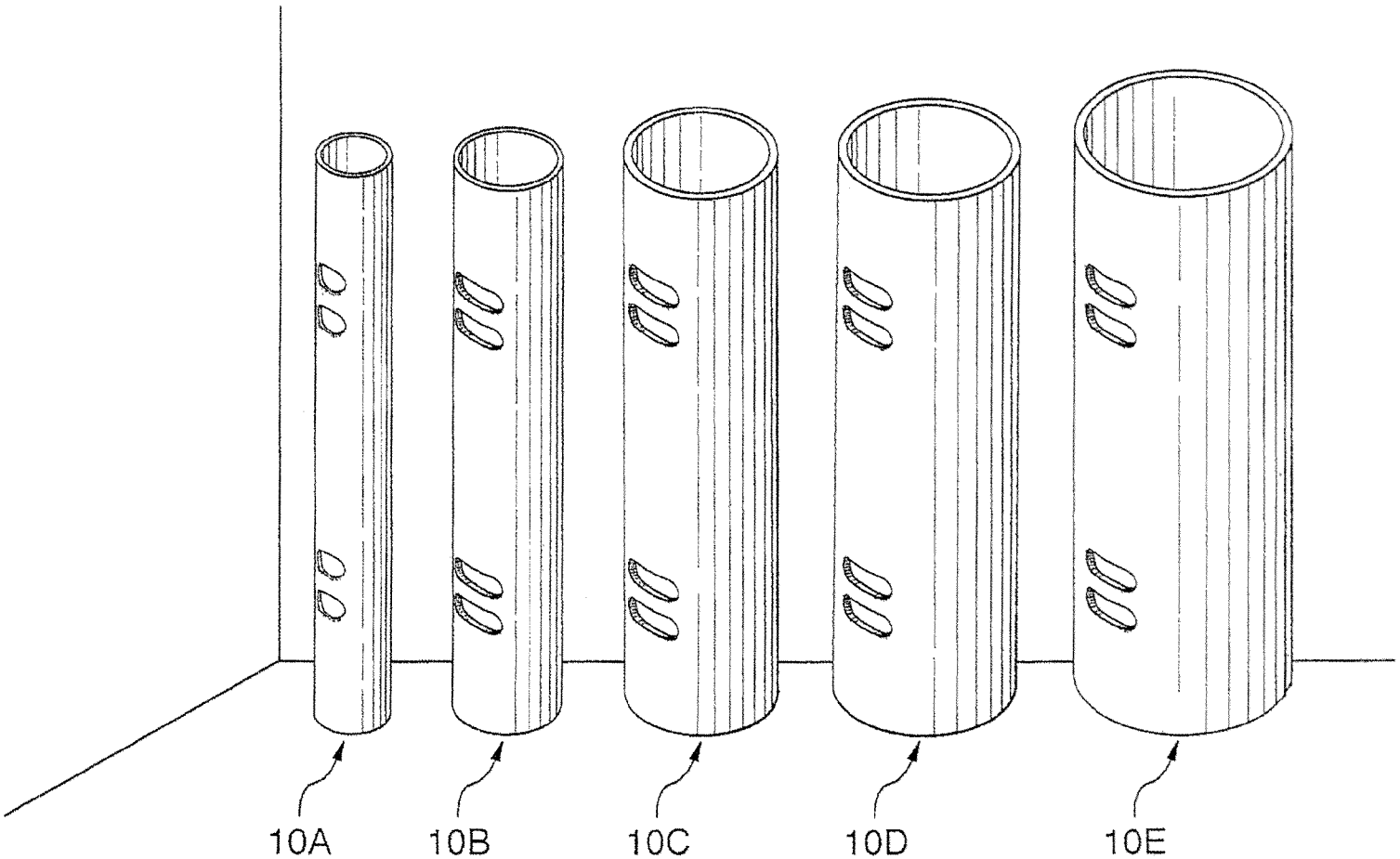
FIG. 3 is a perspective view of a set of exercisers of the type shown in FIG. 1, but of differing dimensions and masses.
Figure 4:
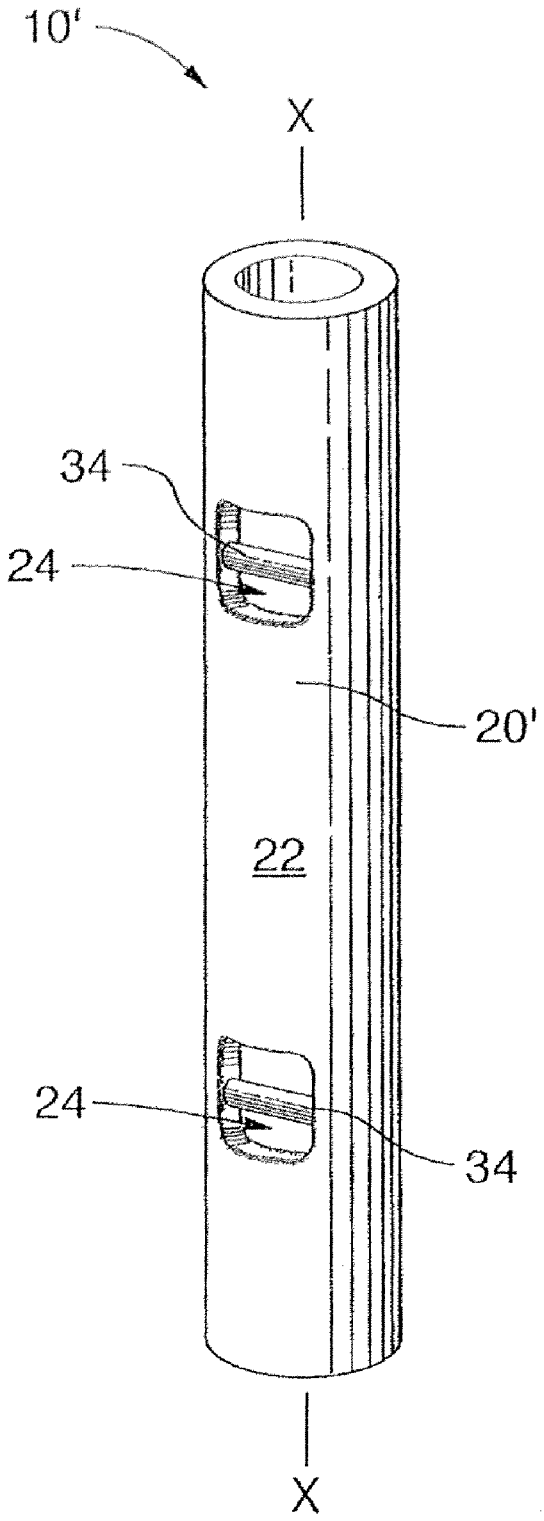
FIG. 4 is a view similar to FIG. 1 of an exerciser apparatus constructed according to an alternate embodiment of the invention.

An alternative embodiment of the exerciser is shown in FIG. 4 and designated with general reference number 10'. This exerciser takes the form of a rod 20' of relatively dense elastomeric foam. Receivers 24 in this embodiment take the form of radially-outwardly-opening recesses, and handles 34 take the form of rigid structures spanning across said recesses. Otherwise, this embodiment is substantially similar to the embodiment of FIG. 1-3, and is numbered commensurately.

The exercisers of FIG. 1-FIG. 4 can be used by persons in the performance of a wide variety of physical training exercises analogous to exercises carried out with dumbbells and/or barbells.

Figure 5:
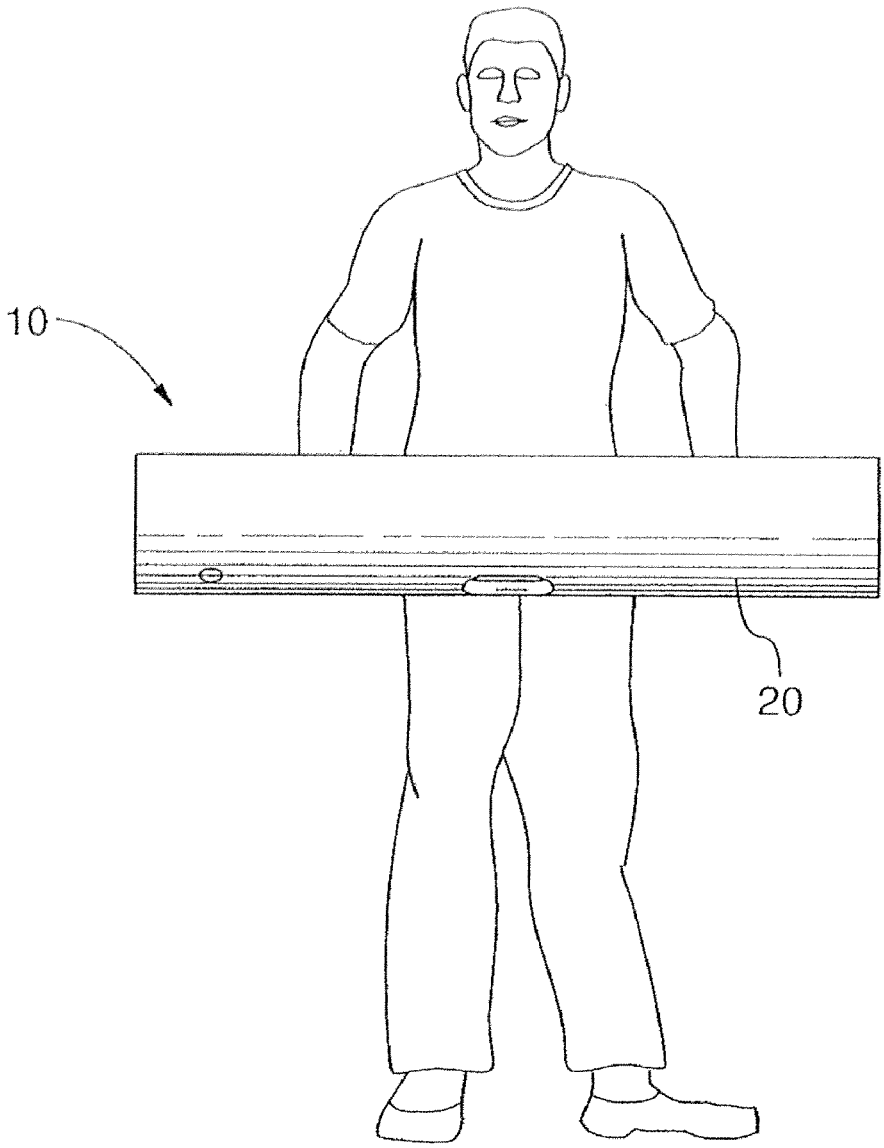
FIG. 5 is a view of the apparatus of FIG. 1 in a first exemplary use.

FIG. 5, for example, shows a person using the exerciser of FIG. 1. Herein, the person is gripping the handles of the pair of apertures at the completion of a bicep curl exercise. This exercise can be performed with relative comfort in comparison to the overall mass of the apparatus, since the mass of the member, being concentrated near the surface, results in the load on the wrists of the person being relatively low. As well, the apertures of the pair are axially-spaced apart from one another about the distance between the shoulders of said person, which permits the bicep curl exercise using this apparatus to be mechanically similar to a bicep curl exercise performed using a conventional barbell.

Figure 6:
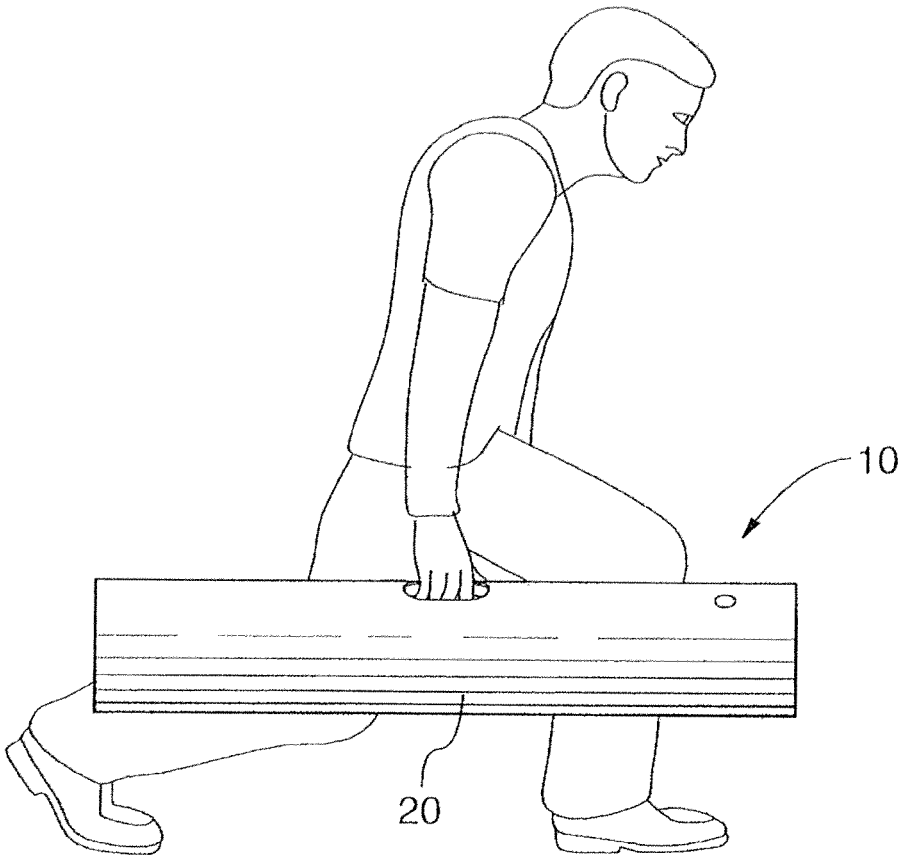
FIG. 6 is a view of the apparatus of FIG. 1 in a second exemplary use.

FIG. 6 shows a person gripping the central handle during the performance of a lunge exercise.

Figure 7:
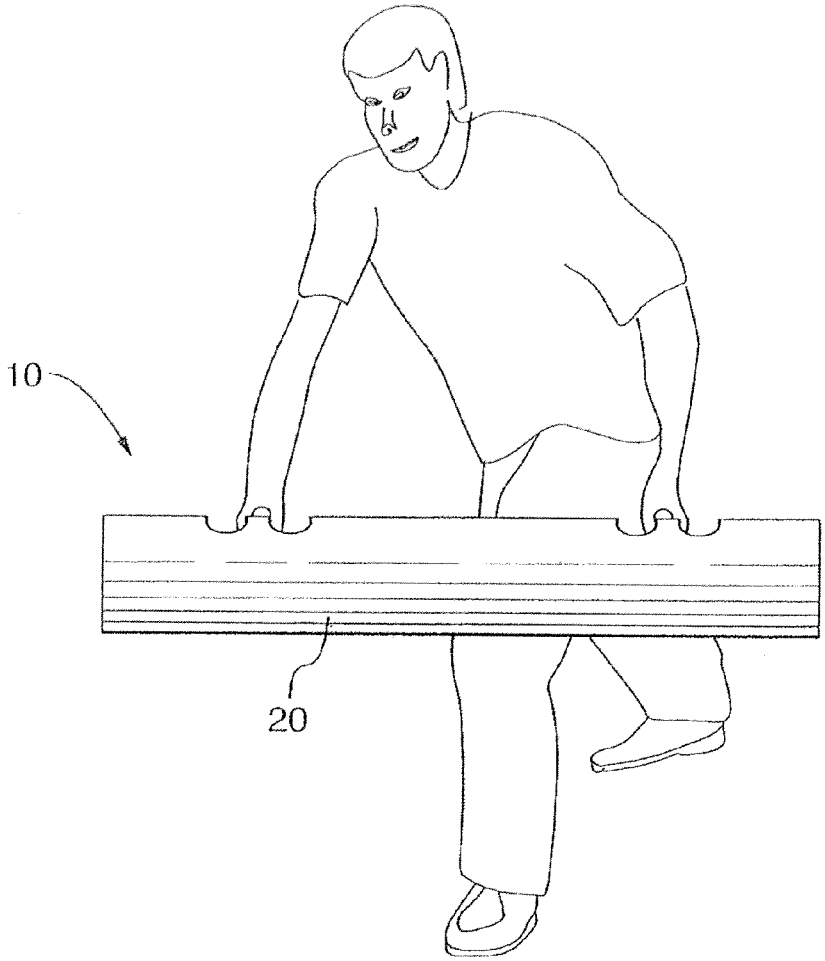
FIG. 7 is a view of the apparatus of FIG. 1 in a third exemplary use.

FIG. 7 shows a person gripping the handles of the pair of receivers while bending sideways.

The apparatus can additionally be used to perform many exercises that are not safe or comfortable with dumbbells or barbells. For example, FIG. 8 shows a person running and dragging the apparatus behind. The apparatus can also be carried across the shoulders while performing such exercises as jumping, running, climbing up and down stairs, bending forwards, bending sideways and rotating about the hip. The elastomeric nature of the tube permits same to compress or be bent slightly, and thereby rest on a user's shoulders without applying pressure directly to the spine.

Whereas but two specific embodiments of the invention have been heretofore discussed, it will be evident that various changes can be made without departing from the scope of the invention.

For example, as shown in FIG. 3, tubes can be formed in a variety of weights and diameters, merely by changing the diameter of the mandrel used and varying the amount of rubber laid-up on the mandrel. Herein, a set of tubes 10A, 10B, 10C, 10D, 10E are shown, which weigh, respectively, 10, 25, 40, 60 and 80 pounds. By way of example, only, the dimensions of the 60 lb unit herein are: length of 4 feet; OD=8.5 inches; ID=6.5 inches]

As well, tubes of different lengths, and different hole configurations can be provided, by, inter alia, varying the cutting pattern. In this regard, the ideal separation of the handles will depend on the size of the user and the exercise being performed. To enable the apparatus to be used in different ways and by different users, it is possible to provide more handles than shown, and these may either be axially aligned with one another or they may be staggered around the circumference of the tube.

As well, whereas a specific type of rubber and method of construction are taught, it should be emphasized that materials other than rubbers and elastomers can be used to form the apparatus, and other methods of construction can be used. By way of example, only, useful tubes have been constructed out of Blue SBR [65+/−5 A Hardness, 1600 psi, 600% Elongation] sheet material and Yellow SBR [70+/−5 A Hardness, 1500 psi Tensile, 500% Elongation] sheet material. Hollow embodiments of the apparatus, for example as illustrated in FIG. 1, could be extruded or possibly roto-molded. Alternatively, the rod form of the invention shown in FIG. 4 could be injection-molded.

Additionally, whereas the embodiments of FIG. 1-FIG. 3 show pairs of apertures separated by handles, this is not necessary. A single aperture, for example, could be provided, and the handle contoured to permit the structure to be gripped without the benefit of an opposing thumb.

Accordingly, it should be understood that the invention is to be limited only by the claims appended hereto, purposively construed.

The invention claimed is:

1. Apparatus for use by a person performing physical training exercises, the apparatus comprising:

a member having a substantial tubular exterior surface, the surface having a central longitudinal axis and defining two or more receivers, the two or more receivers including a pair of receivers, axially-spaced from one another; and for each receiver, a handle for the apparatus, the handle being positioned in each receiver, wherein each handle is defined by a length of material connected to the member and each receiver is defined by a aperture formed through the exterior surface, and wherein the member and handles are formed from elastomeric material, wherein the member is formed from a cylindrical tube centered about a longitudinal axis, and wherein each handle is part of the cylindrical tube such that each handle comprises an arc of a circle centered about and normal to the longitudinal axis.

2. Apparatus according to claim 1, wherein the two or more receivers further includes a central receiver, longitudinally-intermediate the pair of receivers.

3. Apparatus according to claim 2, wherein the central receiver is defined in the exterior surface, opposite the pair of receivers.

4. Apparatus according to claim 1, wherein the handles provided for the pair of receivers are each substantially aligned with an arc of a circle which is centered about the axis.

5. Apparatus according to claim 1, wherein the member is substantially tubular and arranged to allow compression of the member.

6. Apparatus according to claim 1, wherein the member is substantially cylindrical.

7. Apparatus according to claim 1, wherein the member is formed from a cylindrical tube and each handle and the receiver for which it is provided are formed by removing portions of the tube flanking the each handle.

8. Apparatus according to claim 1, wherein the mass of the apparatus is concentrated near the exterior surface.

9. Apparatus according to claim 1, wherein each handle bisects the aperture defining the receiver for which each handle is provided.

10. Apparatus according to claim 1, wherein the pair of receivers are axially-spaced apart from one another about the distance between the shoulders of the person.

11. Apparatus according to claim 1, wherein the member further includes a pair of radially-directed end apertures defined adjacent an end of the member.

12. Apparatus according to claim 11, further comprising a strap securable to the member via one or both of the end apertures, to permit the member to be dragged by the person.

13. Apparatus according to claim 1, wherein the member and handles are formed from rubber.

14. Apparatus according to claim 1, wherein the receivers take the form of radially-outwardly-opening recesses formed in the member.

15. The apparatus of claim 1, further comprising a plurality of apparatuses as claimed in claim 1, wherein a mass of each of the plurality of apparatuses is different, and substantially all of each mass is provided by the associated member having the substantially tubular exterior surface.

16. Apparatus for use by a person performing physical training exercises, the apparatus comprising:

a member having a substantially tubular exterior surface, the surface having a central longitudinal axis and defining two or more receivers, the two or more receivers including a pair of receivers, axially-spaced from one another; and for each receiver, a handle for the apparatus, the handle being positioned in each receiver, wherein the member is constructed from elastomeric material, wherein the member is formed from a cylindrical tube centered about a longitudinal axis, and wherein each handle is part of the cylindrical tube such that each handle comprises an arc of a circle centered about and normal to the longitudinal axis.

17. The apparatus of claim 16, further comprising a plurality of apparatuses as claimed in claim 16, wherein a mass of each of the plurality of apparatuses is different, and substantially all of each mass is provided by the associated member having the substantially tubular exterior surface.

18. Apparatus for use by a person performing physical training exercises, the apparatus comprising:

a tubular member having a substantially tubular exterior surface, the surface having a central longitudinal axis and defining two or more receivers, the two or more receivers including a pair of receivers, axially-spaced from one another about the distance between the shoulders of the person, the tubular member constructed from a material that provides substantially all of a mass of the apparatus when it is in use; and for each receiver, a handle for the apparatus, the handle being positioned in each receiver, wherein the member is formed from a cylindrical tube centered about a longitudinal axis, and wherein each handle is part of the cylindrical tube such that each handle comprises an arc of a circle centered about and normal to the longitudinal axis.

19. Apparatus according to claim 18, wherein the tubular member is constructed from rubber.

20. The apparatus of claim 18, further comprising a plurality of apparatuses as claimed in claim 18, wherein a mass of each of the plurality of apparatuses is different.

* * * * *